US006639992B2

(12) United States Patent
Kobayashi et al.

(10) Patent No.: US 6,639,992 B2
(45) Date of Patent: Oct. 28, 2003

(54) MULTIFUNCTION ACOUSTIC DEVICE

(75) Inventors: Takashi Kobayashi, Yamanashi-ken (JP); Akira Nikaido, Tachikawa (JP); Kenshi Aihara, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 155 days.

(21) Appl. No.: 09/988,270

(22) Filed: Nov. 19, 2001

(65) Prior Publication Data

US 2002/0064295 A1 May 30, 2002

(30) Foreign Application Priority Data

Nov. 24, 2000 (JP) ..... 2000-358565

(51) Int. Cl.[7] ..... H04R 25/00
(52) U.S. Cl. ..... 381/396; 361/162; 361/165
(58) Field of Search ..... 381/396, 412, 381/414, 418, 162, 165, 417; 335/302, 306; 310/154.01, 154.02, 154.03, 154.04, 154.05, 154.06, 264, 27; 340/7.58, 7.62, 7.63, 407.1, 693.5

(56) References Cited

U.S. PATENT DOCUMENTS 4,931,765 A * 6/1990 Rollins et al. ..... 381/417
5,802,189 A * 9/1998 Blodget ..... 381/162

* cited by examiner

*Primary Examiner*—Huyen Le
(74) *Attorney, Agent, or Firm*—Dennison, Schultz & Dougherty

(57) ABSTRACT

A speaker diaphragm is supported in a frame and a voice coil is secured to the speaker diaphragm. A rotor having a central permanent magnet and a cylindrical hub provided around the central permanent magnet is rotatably supported in the frame. A motor annular permanent magnet is disposed around the rotor. The voice coil is disposed in the gap formed between the central permanent magnet and the hub.

6 Claims, 6 Drawing Sheets

MULTIFUNCTION ACOUSTIC DEVICE

BACKGROUND OF THE INVENTION

The present invention relates to a multifunction acoustic device used in a portable instrument such as a portable telephone.

There has been provided an acoustic device of the portable instrument in which a speaker is provided for generating sounds of calling signals, and a vibrating motor is provided for informing the receiver of calling signals without generating sounds. In such a device, since both of the speaker and the motor are mounted in the device, the device is increased in size and weight, and in manufacturing cost.

In recent years, there is provided a multifunction acoustic device in order to remove the above described disadvantages. The multifunction acoustic device comprises a speaker having a vibrating plate and a permanent magnet magnetically connected to a voice coil mounted on the vibrating plate of the speaker. The permanent magnet is independently vibrated at a low frequency of 100–150 Hz so as to inform the receiving of calling signals by the vibration of the case of the device, which is transmitted to the body of the user of the device.

FIG. 6 is a sectional view of a conventional electromagnetic induction converter disclosed in Japanese Patent Laid Open 5-85192. The converter comprises a diaphragm 506 mounted in a case 512 at a periphery thereof, a voice coil 508 secured to the underside of a central portion 507 of the diaphragm 506, a spring plate 511 mounted in the case 512, and a permanent magnet 510 secured to a central portion of the spring plate 511, inserted in the voice coil 508.

By applying a low or high frequency signal to the voice coil 508, the spring plate 511 is vibrated in the polarity direction Y of the magnet 510.

In the device, the diaphragm 506 and the spring plate 511 are relatively moved through the magnetic combination between the voice coil 508 and the magnet 510. Consequently, when a low frequency signal or a high frequency signal is applied to the voice coil 508, both of the diaphragm 506 and the spring plate 511 are sequentially vibrated. As a result, sounds such as voice, music and others generated from the device are distorted, thereby reducing the quality of the sound. In addition, vibrating both of the voice coil 508 and the magnet 510 causes the low frequency vibration of the magnet to superimpose on the magnetic combination of the voice coil 508 and the magnet 510, which further largely distorts the sounds.

FIG. 7 is a sectional view showing a conventional multifunction acoustic device. The device comprises a speaker vibrating plate 603 made of plastic and having a corrugated periphery 603*a* and a central dome, a voice coil 604 secured to the underside of the vibrating plate 603 at a central portion, and a magnet composition 610. The vibrating plate 603 is secured to a frame 609 with adhesives.

The magnetic composition 610 comprises a lower yoke 605, a core 601 formed on the yoke 605 at a central portion thereof, an annular permanent magnet 602 mounted on the lower yoke 605, and an annular upper yoke 606 mounted on the permanent magnet 602. The lower yoke 605 and the upper yoke 606 are resiliently supported in the frame 609 by spring plates 607 and 608. A magnetic gap 611 is formed between a periphery 601*a* of the core 601 and an inside wall 606*a* of the upper yoke 606 to be magnetically connected to the voice coil 604.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

As a result, sounds such as voice, music and others generated from the device are distorted, thereby reducing the quality of the sound. In addition, the driving of both the voice coil 604 and the magnetic composition 610 causes the low frequency vibration to superimpose on the magnetic combination of the voice coil 604 and the magnetic composition 610, which further largely distorts the sounds.

FIG. 8 is a sectional view showing another conventional multifunction acoustic device. The device comprises the speaker vibrating plate 603 made of plastic and having the corrugated periphery 603*a* and the central dome, the voice coil 604 secured to the underside of the vibrating plate 603 at a central portion, and the magnet composition 610. The vibrating plate 603 is secured to the frame 609 with adhesives.

The magnetic composition 610 comprises a lower yoke 703, core 601 formed on the yoke 703 at a central portion thereof, an annular permanent magnet 702 secured to the lower yoke 703, and annular upper yoke 606 having a peripheral wall 606*b* and mounted on the permanent magnet 602. The upper yoke 606 is resiliently supported in the frame 609 by spring plates 707 and 708. A first magnetic gap 701 is formed between a periphery 601*a* of the core 601 and an inside wall of the upper yoke 606 to be magnetically connected to the voice coil 604. A second gap 705 is formed between a periphery 703*a* of the lower yoke 703 and inside wall 606*a* of the upper yoke 606. A driving coil 706 is secured to the frame and inserted in the second gap 705.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

When a high frequency signal for music is applied to the voice coil 604, only the speaker vibrating plate 603 is vibrated. Therefore, there does not occur distortion of the sound. Furthermore, when a low frequency signal is applied to the driving coil 706, only the magnetic composition 610 is vibrated, and the speaker vibrating plate 603 is not vibrated.

However if a high frequency signal is applied to input terminals 612*a*, 612*b*, and a low frequency signal is also applied to input terminals 704*a*, 704*b*, the speaker vibrating plate 603 and magnetic composition 610 are sequentially vibrated, thereby reducing the sound quality.

In the above described conventional devices, both the speaker vibration plate and the magnetic composition are vibrated when a low frequency signal or a high frequency signal is applied to the voice coil. This is caused by the reason that the low frequency vibrating composition is vibrated in the same direction as the high frequency vibrating direction.

SUMMARY OF THE INVENTION

An object of the present invention is to provide a multifunction acoustic device in which a vibrating member is not vibrated together with another vibrating member, thereby removing disadvantages of conventional devices.

According to the present invention, there is provided a multifunction acoustic device comprising a frame, a speaker diaphragm supported in the frame, a voice coil secured to the speaker diaphragm, a rotor having a central permanent magnet and a cylindrical hub provided around the central permanent magnet, and rotatably supported in the frame, a motor annular permanent magnet disposed around the rotor, the voice coil being disposed in the gap formed between the central permanent magnet and the hub.

The rotor comprises an armature and a commutator.

The device further comprises a weight eccentrically provided on the rotor.

The armature comprises cores secured to the hub, and coils mounted on the cores, and the commutator comprises segments and a pair of brushes for applying a current to the coils through the segments.

These and other objects and features of the present invention will become more apparent from the following detailed description with reference to the accompanying drawings.

DETAILED DESCRIPTION OF THE PREFERRED EMBODIMENT

Figure 1:
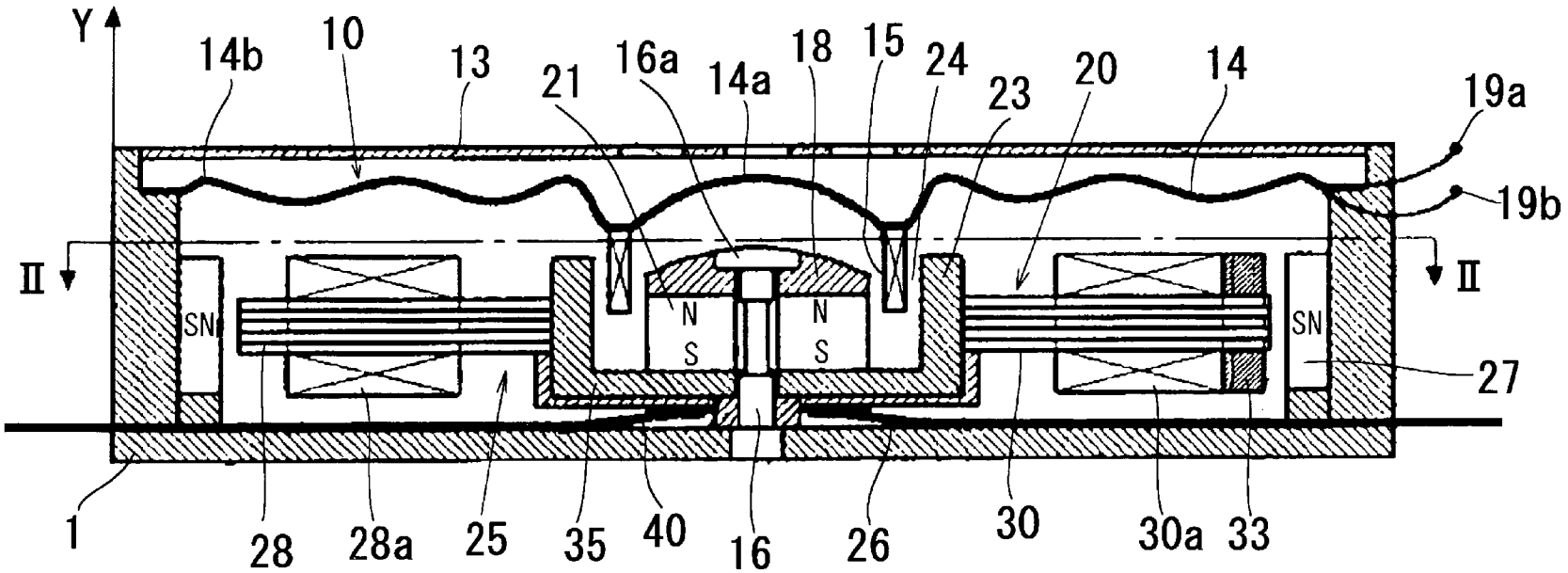
FIG. 1 is a sectional view of a multifunction acoustic device of the present invention.
Figure 2:
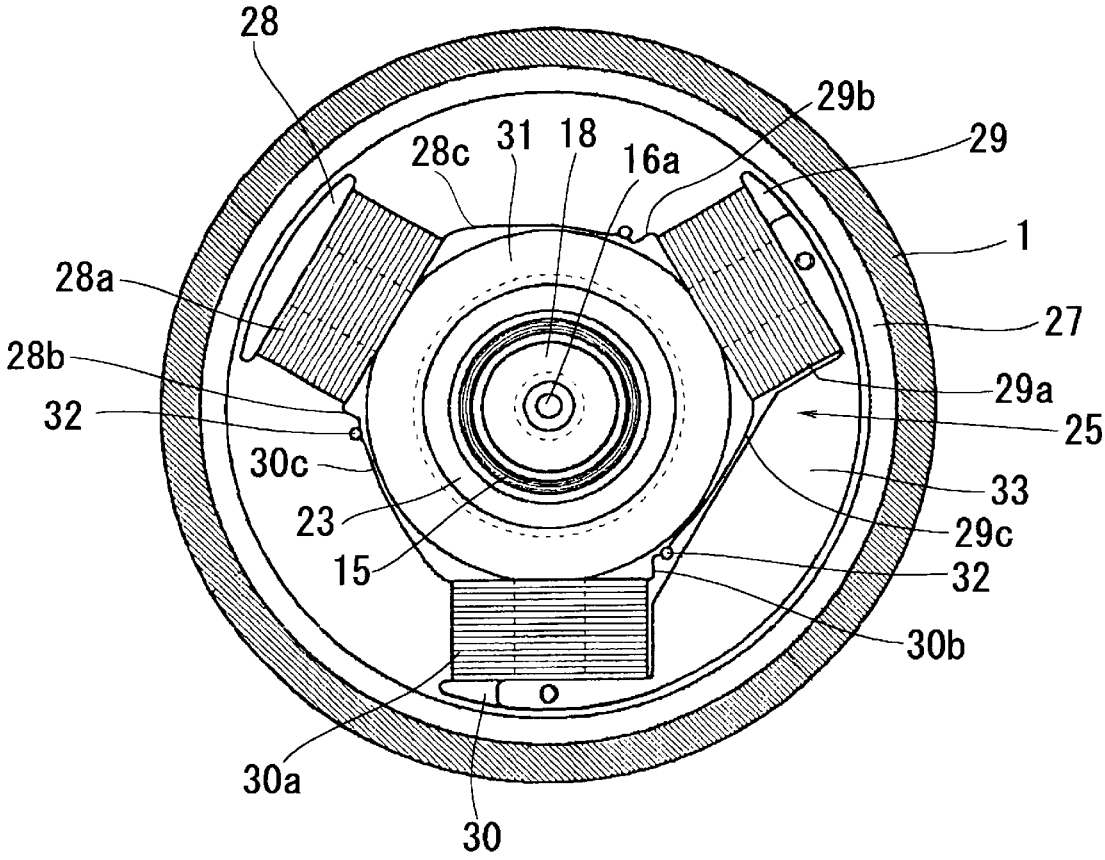
FIG. 2 is a sectional view taken along a line II—II of FIG. 1.

Referring to FIGS. 1 and 2, the multifunction acoustic device of the present invention comprises a sound producing device 10, and a direct current motor 20 provided in a cylindrical frame 1 made of plastic or magnetic material. The sound producing device 10 comprises a speaker diaphragm 14 having a central dome 14*a* and secured to the frame at a periphery 14*b* with adhesives, a voice coil 15 secured to the underside of the speaker diaphragm 14. The speaker diaphragm 14 is covered by a cover 13 having a plurality of sound discharge holes and secured to the frame 1 at a peripheral edge thereof.

The direct current motor 20 has a hub 23 having a flat cup shape and made of magnetic material which also acts a role of a yoke for the sound producing device 10. The hub 23 is secured to a shaft 16 which is rotatably mounted on a base plate of the frame 1.

On the bottom of the hub 23, a cylindrical speaker central permanent magnet 21 and a top plate 18 made of magnetic material are stacked around the shaft 16 and secured to each other by a large diameter flange 16*a* of the shaft 16. The permanent magnet 21 is magnetized in the axial direction. The voice coil 15 is disposed in a magnetic gap 24 between the peripheral inside wall of the hub 23 and the peripheral wall of the top plate 18.

Figure 3:
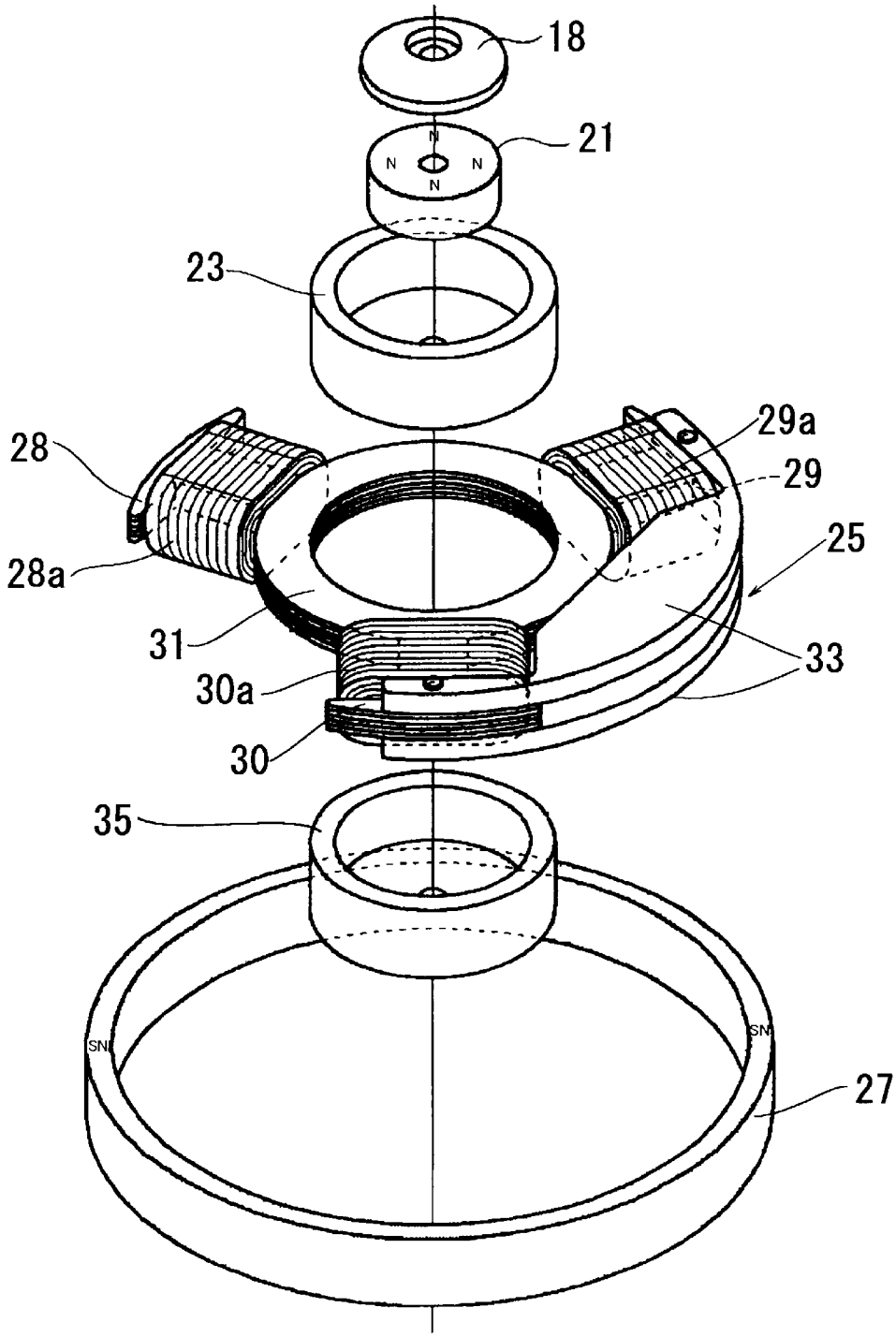
FIG. 3 is an exploded perspective view of a rotor of the multifunction acoustic device of the present invention.

The direct current motor 20 further comprises a rotor 25 comprising an armature, a commutator 26, and a motor annular permanent magnet 27. As shown in FIGS. 2 and 3, the rotor 25 has three cores 28, 29 and 30 formed around a central ring 31 as shown in FIGS. 2 and 3. On the cores 28, 29 and 30, armature coil 28*a*, 29*a* and 30*a* are attached. A pair of eccentric weights 33 are secured to the cores 29 and 30. The central ring 31 is secured to the hub 23.

A commutator holding frame 35 made of plastic and having a disk shape is secured to the peripheral wall of the hub 23.

Figure 4:
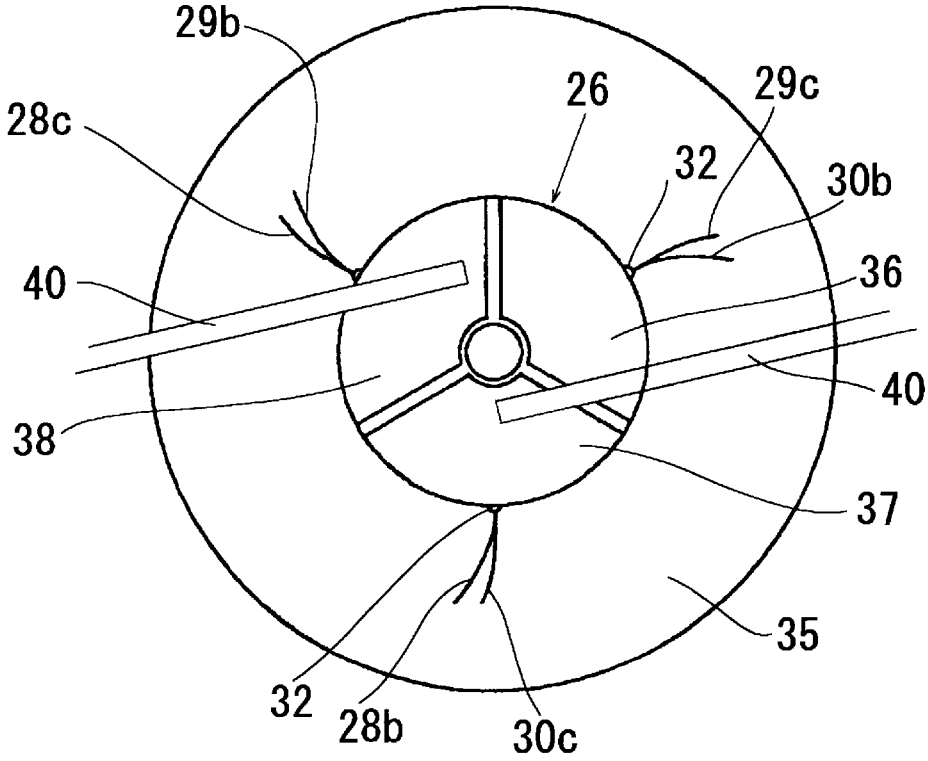
FIG. 4 is a plan view of the underside of a commutator of the multifunction acoustic device of the present invention.
Figure 5:
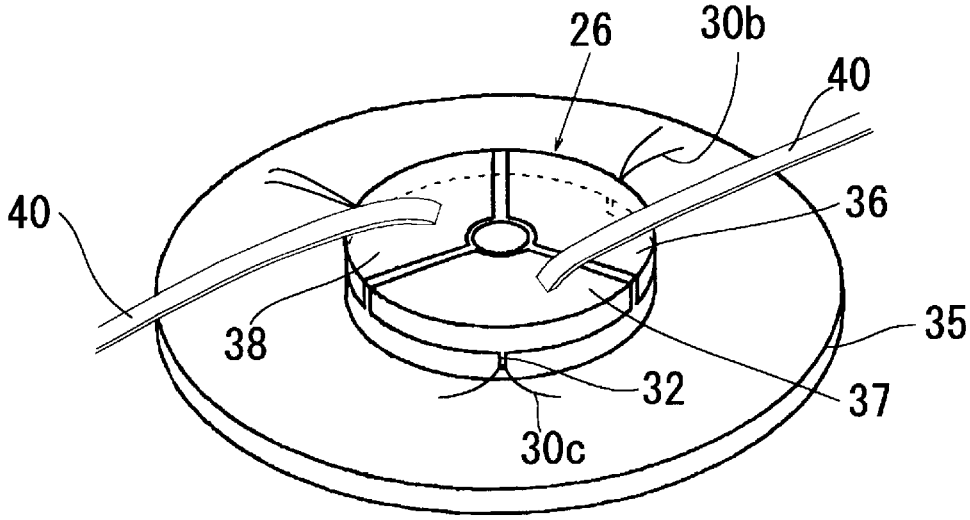
FIG. 5 is a perspective view of the commutator of FIG. 4.
Figure 6:
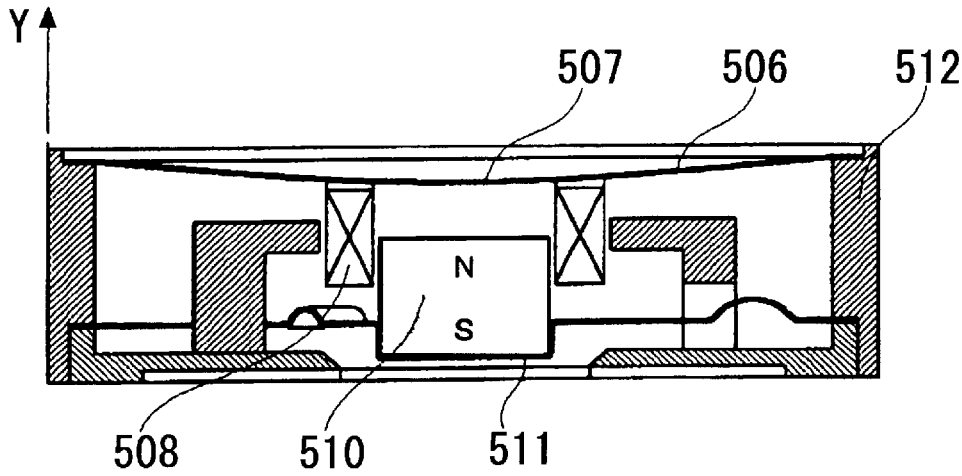
FIG. 6 PRIOR ART
FIG. 6 is a sectional view of a conventional electromagnetic induction converter.
Figure 7:
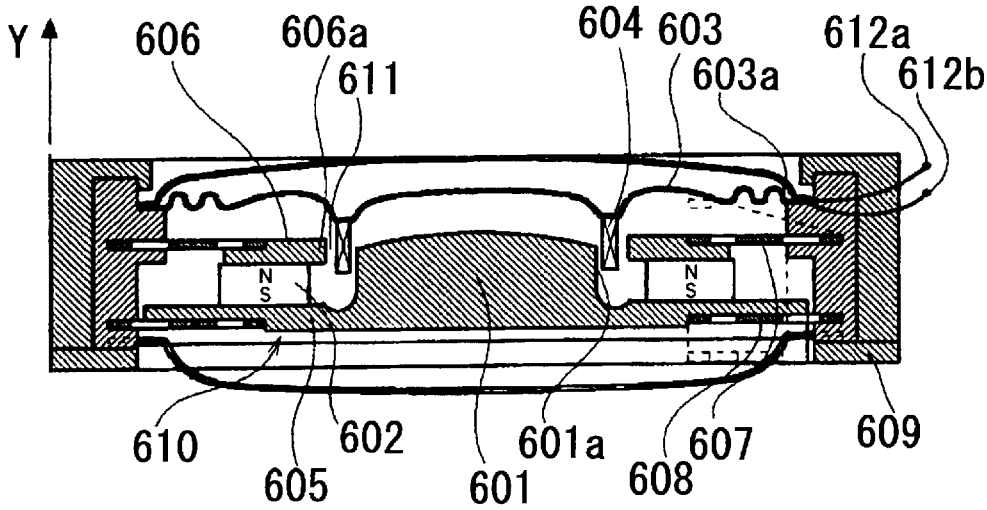
FIG. 7 PRIOR ART
FIG. 7 is a sectional view showing a conventional multifunction acoustic device.
Figure 8:
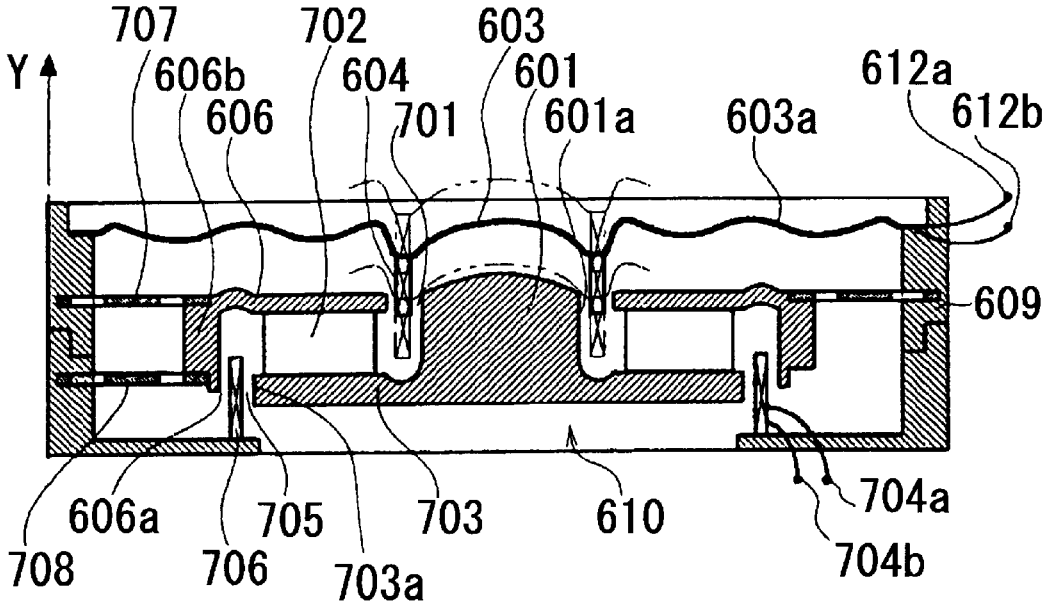
FIG. 8 PRIOR ART
FIG. 8 is a sectional view showing another conventional multifunction acoustic device.

As shown in FIGS. 4 and 5, three commutator segments 36, 37 and 38 are formed on the underside of the commutator holding frame 35 by metal plating.

Both ends of each of the armature coils 28*a*, 29*a* and 30*a* are connected to adjacent commutator segments by a terminal 32 at the peripheral walls of the segments. For example, both ends 30*b* and 30*c* of the coil 30*a* are connected to terminals 32 of adjacent segments 36 and 37 as shown in FIGS. 2, 4 and 5.

As shown in FIGS. 4 and 5, a pair of brushes 40 are provided so that an inner end portion of each brush contacts with segments 36, 37, 38 when rotating. A base portion of the brush 40 is secured to the frame 1 by adhesive. In the case of metallic frame, the base portion is secured to the frame, interposing an insulator. The base of the brush is projected from the frame 1 and connected to a direct current source (not shown).

The motor permanent magnet 27 is magnetized in radial directions at plural poles.

In operation, when a high frequency signal is applied to input terminals 19*a* and 19*b* (FIG. 1) of the voice coil 15, the speaker diaphragm 14 is vibrated in the Y direction (FIG. 1) to produce sounds.

When a direct current is applied to the coils 28*a*, 29*a* and 30*a* through the brushes 40, driving torque between the cores 28 to 30 and the permanent magnet 27 generates. Thus, the rotor 25 rotates. Since the weights 33 are eccentrically mounted on the rotor 25, the rotor vibrates in radial direction. The vibration is transmitted to user's body through the frame 1 and a case of the device so that a calling signal is informed to the user.

The load torque TL is expressed as follows.

$$TL=\mu rR\omega^2M(N\cdot m)$$

where

M is the mass of weights 33 of the rotor,

R is the length between the center of the rotor shaft 16 and the center of gravity of the weights 33, r is the radius of the rotor shaft 16, $\mu$ is the friction coefficient between the rotor shaft 16 and the rotor 25, $\omega$ is the number of rotation (rad/sec) of the rotor 20.

Since the rotor 25 merely bears the load torque TL, the power consumption of the device is small.

If a lower frequency signal is applied to the brushes 40 to rotate the rotor 25 during the generating sounds by the speaker diaphragm 14, the magnetic flux density in the gap 24 does not change from the magnetic flux density when only the speaker diaphragm 14 is vibrated.

From the foregoing description, it will be understood that the present invention provides a multifunction acoustic device which may produce sounds and vibration of the frame at the same time without reducing sound quality. In the prior art, since the speaker diaphragm and the magnetic composition are vibrated in the same direction, the thickness of the device increases. In the device of the present invention, since the magnetic composition rotates, the thickness of the device can be reduced.

While the invention has been described in conjunction with preferred specific embodiment thereof, it will be understood that this description is intended to illustrate and not limit the scope of the invention, which is defined by the following claims.

What is claimed is:

1. A multifunction acoustic device comprising:

a frame;

a speaker diaphragm supported in the frame;

a voice coil secured to the speaker diaphragm;

a rotor having a central permanent magnet and a cylindrical hub provided around the central permanent magnet, and rotatably supported in the frame;

a motor annular permanent magnet disposed around the rotor;

the voice coil being disposed in the gap formed between the central permanent magnet and the hub.

2. The device according to claim 1 wherein the rotor comprises an armature and a commutator.

3. The device according to claim 2 wherein the armature comprises cores secured to the hub, and coils mounted on the cores, and the commutator comprises segments and a pair of brushes for applying a current to the coils through the segments.

4. The device according to claim 1 further comprising eccentric means provided on the rotor for vibrating the rotor during the rotation of the rotor.

5. The device according to claim 4 wherein the eccentric means is a weight eccentrically provided on the rotor.

6. The device according to claim 1 wherein the central permanent magnet is an annular magnet.

* * * * *